US006676281B2

(12) United States Patent
Bray et al.

(10) Patent No.: US 6,676,281 B2
(45) Date of Patent: Jan. 13, 2004

(54) RAIL LIGHTING SYSTEM

(75) Inventors: Douglas R. Bray, Medford Lakes, NJ (US); Stefano Caposecco, Cinnaminson, NJ (US); Andrzej Duljas, Moorestown, NJ (US)

(73) Assignee: Sea Gull Lighting Products, Inc., Riverside, NJ (US)

( * ) Notice: Subject to any disclaimer, the term of this patent is extended or adjusted under 35 U.S.C. 154(b) by 0 days.

(21) Appl. No.: 10/152,899

(22) Filed: May 21, 2002

(65) Prior Publication Data

US 2003/0031018 A1 Feb. 13, 2003

Related U.S. Application Data

(60) Provisional application No. 60/292,998, filed on May 23, 2001.

(51) Int. Cl.[7] ..... F21V 21/00

(52) U.S. Cl. ..... 362/391; 362/226; 362/239; 362/405; 362/402; 362/396

(58) Field of Search ..... 362/391, 226, 362/239, 405, 402, 396; 439/110, 111, 112, 116, 117, 119, 259, 263, 266

(56) References Cited

U.S. PATENT DOCUMENTS 5,967,818 A * 10/1999 Carron et al. ..... 439/211
6,224,411 B1 * 5/2001 Maag ..... 439/259

* cited by examiner

*Primary Examiner*—Sandra O'Shea
*Assistant Examiner*—Mark Tsidulko
(74) *Attorney, Agent, or Firm*—Drinker Biddle & Reath LLP

(57) ABSTRACT

A rail lighting system includes an adapter having contact members with elongated portions. A body having an opening for a rail receives the contacts such that the elongated portions extend adjacent the rail. A wedge includes members that engage the contacts to urge the elongated portions toward the rail. The wedge is secured to a cap that threadedly engages the body. The rail includes at least one conductor in opposite end portions of the rail with respect to its depth. The conductors of the rail may include a single conductor or, alternatively conductors on opposite sides of the rail. A lighting fixture spring clip includes sets of opposite tangs including a first set having V-shaped end portions to engage a notched lamp base and a second set having curved end portions for engaging an enclosure barrier.

17 Claims, 9 Drawing Sheets

RAIL LIGHTING SYSTEM

CROSS REFERENCE TO RELATED APPLICATIONS

The present application claims the benefit of U.S. Provisional Application Ser. No. 60/292,998, filed May 23, 2001.

FIELD OF THE INVENTION

The present invention relates to lighting systems and, more particularly, to rail lighting systems in which lighting fixtures are secured to a rail.

BACKGROUND OF THE INVENTION

A rail lighting system includes a rail mounted on a supporting surface, such as a wall, a ceiling, or the bottom of a cabinet, for example. The rail provides support for lighting fixtures and includes electrical conductors for supplying electric power to the lighting fixtures. Known rail lighting systems include rails that can be bent to accommodate a corner, for example. Rail lighting systems may use low voltage lighting fixtures having 12-volt or 24-volt lamps, for example, by including a 110-volt step down transformer that provides 12 volts or 24 volts to the rail.

Rail lighting systems typically include adapters to secure the lighting fixtures to the rail and to provide for electrical connection between electrical conductors of the rail and the lighting fixture. Known adapters have an opening for receiving the rail of a rail lighting system, and support electrically conductive contacts adjacent the opening to provide a current path connecting the rail to the lighting fixtures.

The rail provides desirable flexibility in the placement of lighting fixtures. The locations of the lighting fixtures may be adjusted by attaching the adapter at various points along the rail. To ensure a reliable current pathway through the adapter, however, it is necessary that a firm connection be made between the electrical contacts of the adapter and the rail. In known rail lighting systems, the contacts are mounted within the adapter such that compressive force is created to hold the contacts to the rail. In such systems, the attachment of the adapter onto the rail can result in scratching of the rail surface by the contacts.

SUMMARY OF THE INVENTION

The present invention provides an adapter for securing a lighting fixture to the rail of a rail lighting system. The adapter includes a body having an opening for receiving the rail of a rail lighting system. The adapter further includes first and second electrically conductive contact members supported by the body. Each of the contact members includes an elongated portion adjacent the opening having a length sufficient to contact a respective electrical conductor of the rail of a rail lighting system received in the opening. The adapter also includes a wedge that is insertable into the body. The wedge has respective first and second members dimensioned to contact the elongated portions of the electrically conductive contact members when the wedge is fully inserted into the body. The contact between the wedge and the contact members resulting in movement of the elongated portions of the contact members toward the respective electrical conductors of the rail.

The present invention also provides a rail lighting system having a rail. The system includes at least one adapter constructed as described in the preceding paragraph. The rail of rail lighting system is received in the opening of each of the adapters. The rail lighting system further includes a lighting fixture secured to each of the adapters. Each lighting fixture includes conductors extending from the lighting fixture and electrically connected to the contact members of one of the adapters.

The present invention further provides a spring clip for a lighting fixture. The spring clip includes first and second pairs of opposite tangs. The first pair of tangs is oriented substantially perpendicularly to the second pair of tangs. The first pair of tangs includes substantially V-shaped end portions for engagement with a notched base of a lamp. The second pair of tangs includes curved end portions for engaging a correspondingly curved portion of a lamp containment barrier.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

DETAILED DESCRIPTION OF THE DRAWINGS

Figure 1:
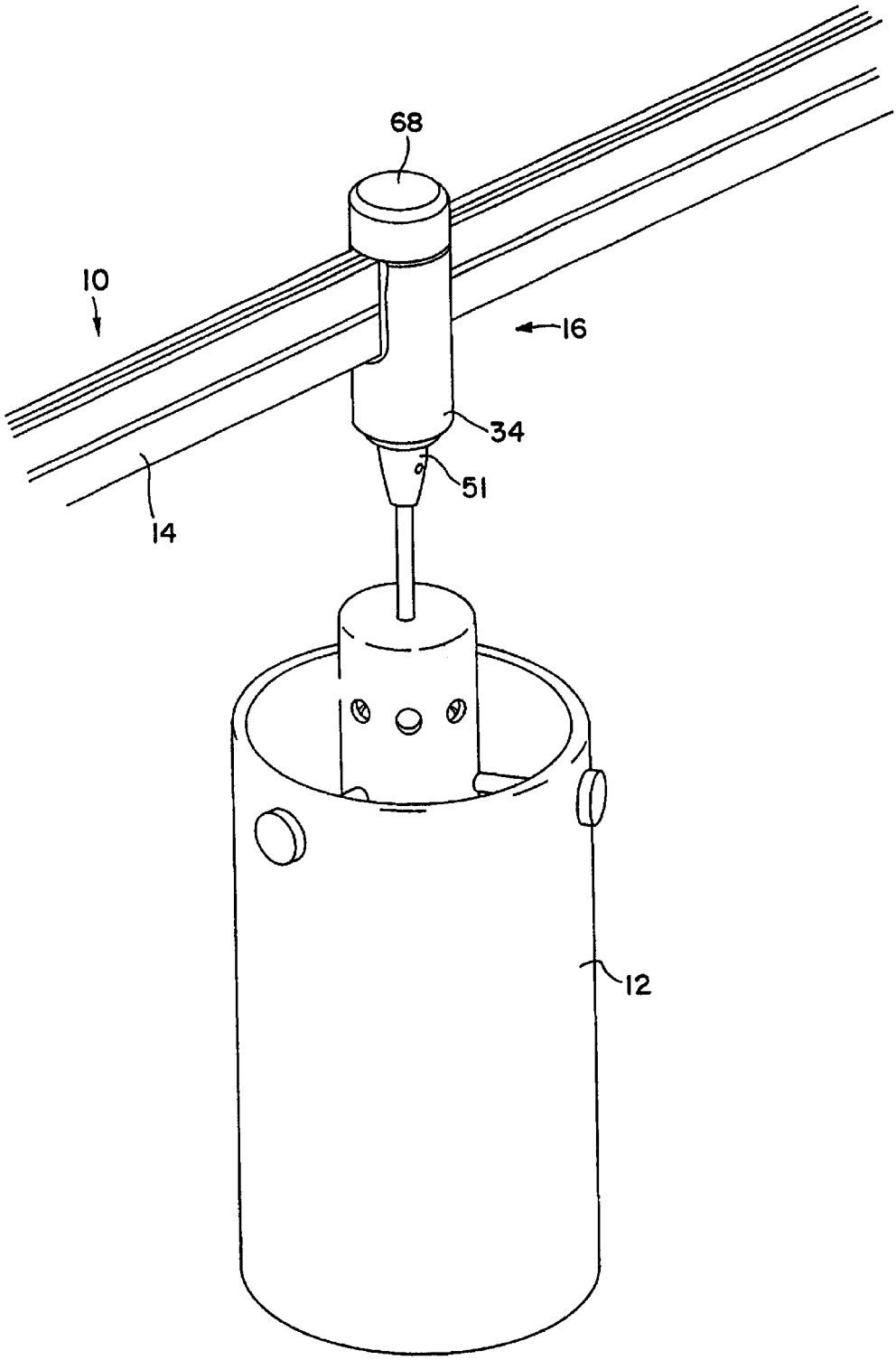
FIG. 1 is a perspective view of a pendant light fixture mounted on a rail using an adapter assembly according to the present invention.
Figure 2:
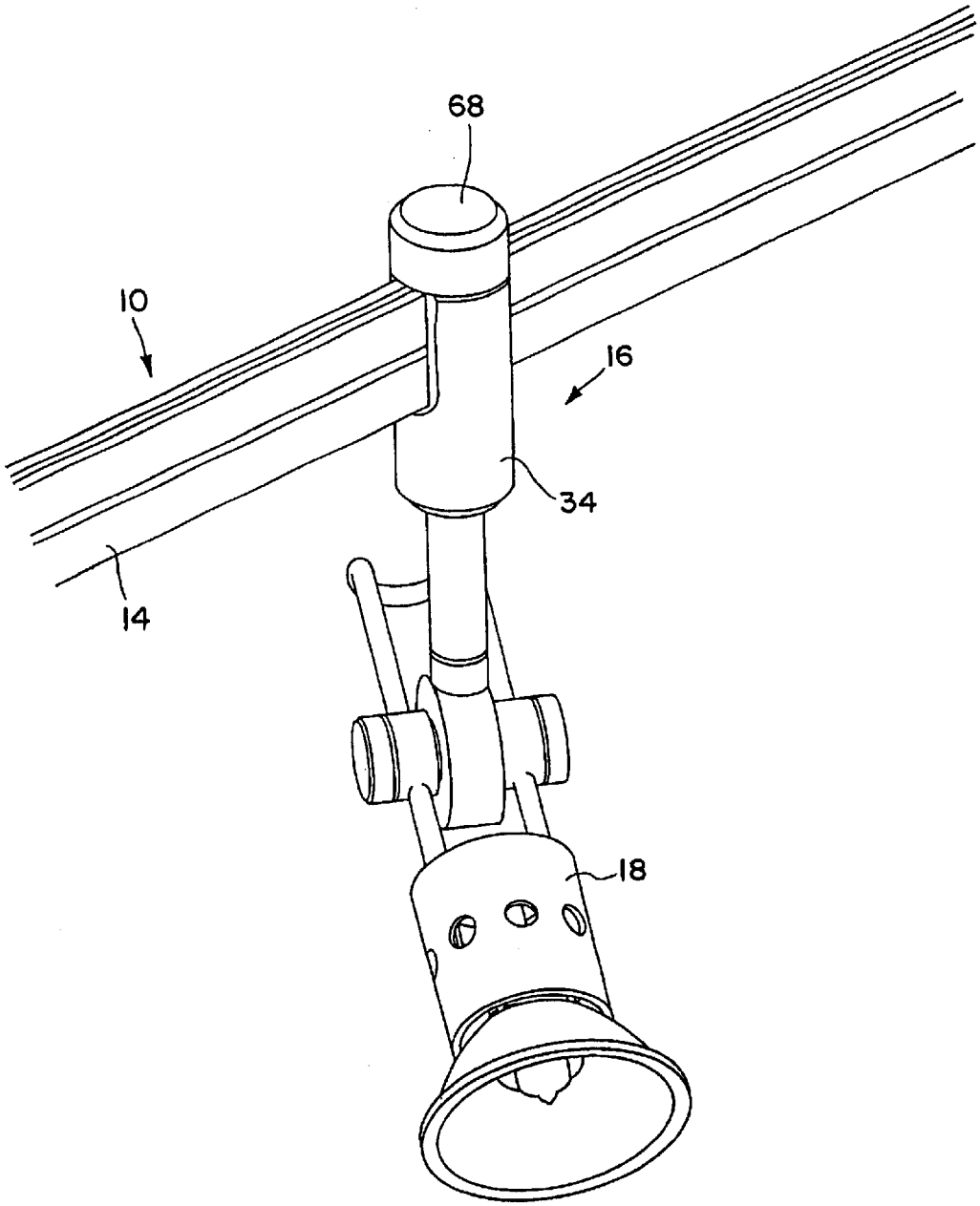
FIG. 2 is a perspective view of a spotlight fixture mounted on a rail using an adapter assembly according to the present invention.

Referring to the drawings, where like numerals identify like elements, there is illustrated in FIGS. 1 and 2 a rail lighting system 10 according to the present invention. The lighting system 10 is shown in FIG. 1 supporting a pendant lighting fixture 12. The rail lighting system 10 includes an elongated low-voltage rail 14 and an adapter assembly 16 that attaches lighting fixture 12 to rail 14. The rail 14, as will be described in greater detail, includes conductive elements that extend along the rail to provide electric current to the pendant lighting fixture 12 through the adapter assembly 16. In FIG. 2, the adapter assembly 16 is shown supporting a spotlight fixture 18. The rail system 10 can also be used to power wall washers, up lights, and other lighting fixtures.

Figure 3:
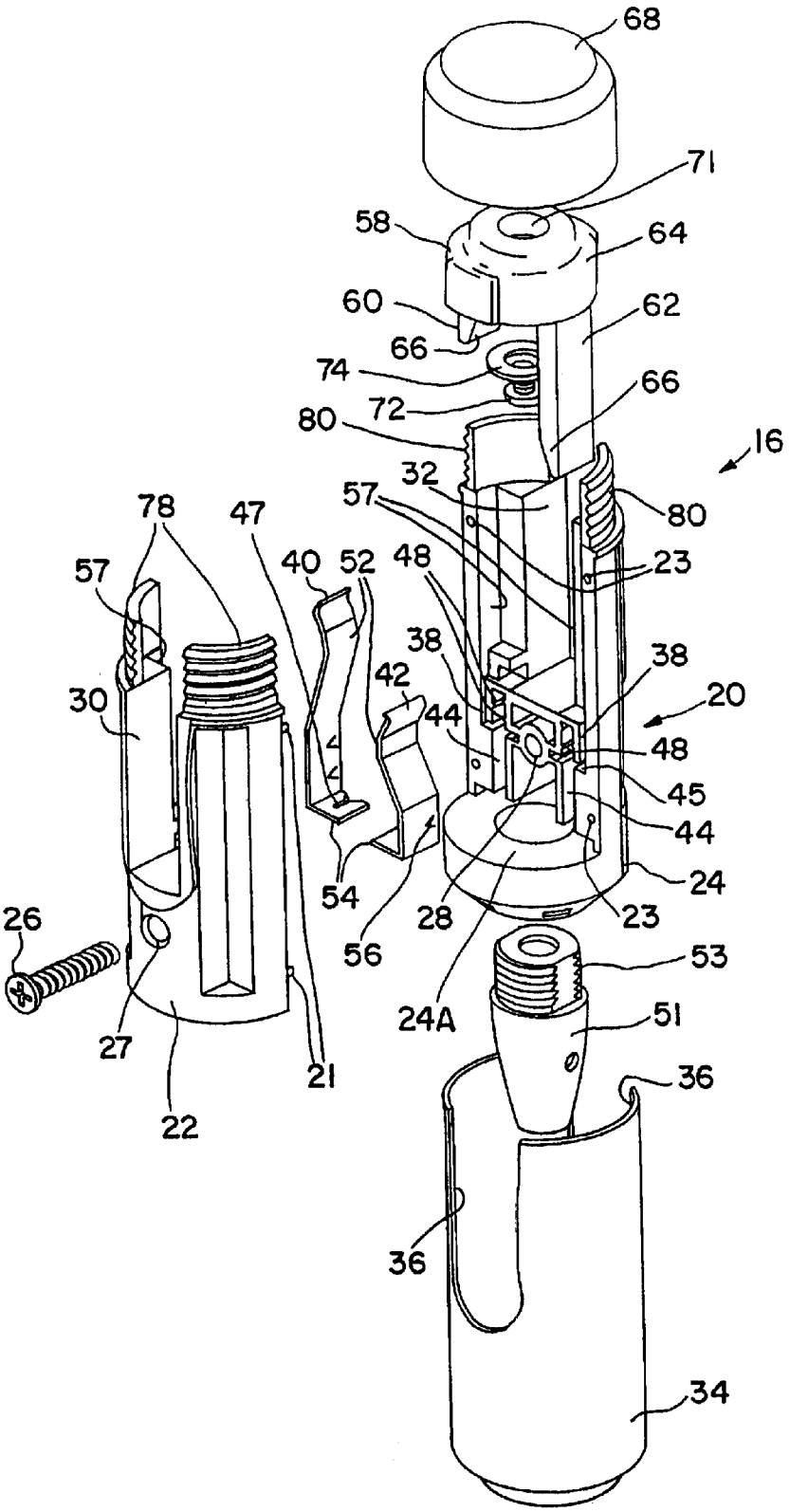
FIG. 3 is an exploded perspective view of an adapter assembly according to the present invention.

The adapter assembly 16 is shown in greater detail in FIGS. 3–6. The adapter assembly 16 includes an adapter body 20 having a first half 22 and a mating second half 24. As shown in FIG. 3, the first half 22 includes pegs 21 received in corresponding holes 23 in the second half 24. The first and second halves 22, 24 of the adapter body 20 are secured together such as by screw 26 that passes through a hole 27 in the first half 22 and is received in a threaded bore 28 in second half 24. The first and second halves 22, 24 of adapter body 20 define channels 30, 32, respectively, that provide an opening in the adapter body for mounting the adapter assembly 16 on rail 14 as shown in FIGS. 1 and 2. The adapter assembly 16 further includes a generally cylindrical shell 34 that substantially encloses the adapter body 20. The shell 34 includes slots 36 on opposite sides to accommodate the rail 14 as shown in FIGS. 1 and 2.

Figure 4:
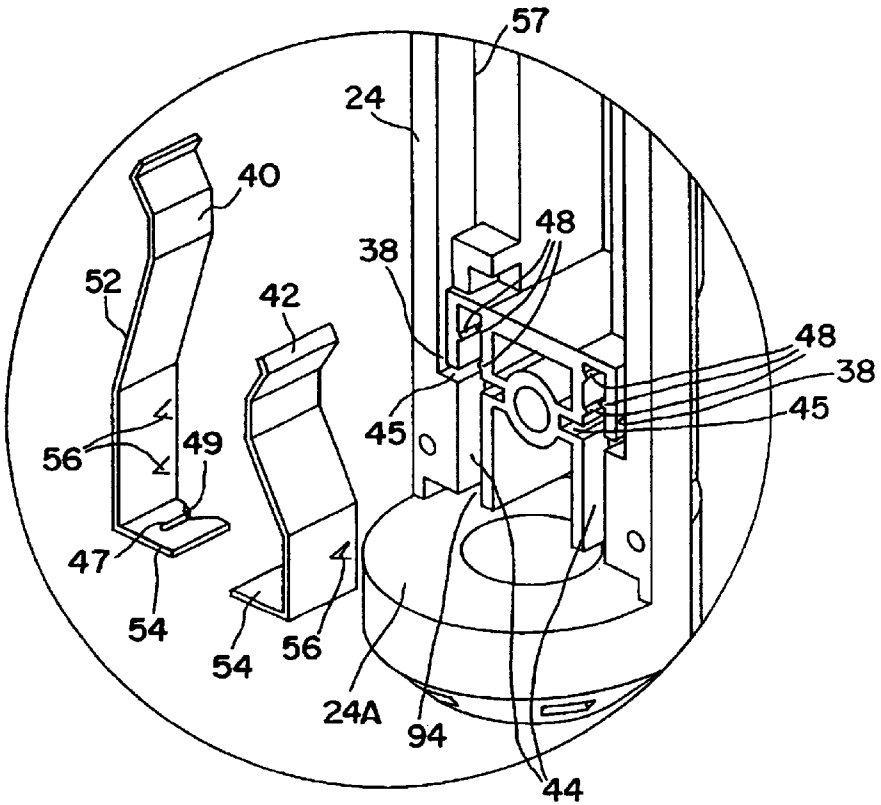
FIG. 4 is an enlarged detail of a portion of the adapter assembly of FIG. 3.

Referring to FIG. 4, the adapter body 20 includes recesses 38 on opposite sides for receiving electrically conductive contacts 40, 42. The recesses 38 in the second half 24 of adapter body 20 are visible, it being understood that corresponding recesses (not visible) are provided in the first half 22 of body 20. The adapter body 20 further includes channels 44 on opposite sides for receiving electrical conductors 46 (as can be seen in FIGS. 7–10). Each channel 44 includes projections 48 for securing an end 50 of a conductor 46 within the channel. The channels 44 include cross-slots 45, generally perpendicular to the long dimension of the channel.

Each of the electrically conductive contacts 40, 42 of the adapter assembly 16 includes an elongated portion 52 and an end wall portion 54 substantially perpendicular to the elongated portion 52. The end wall portions 54 of the contacts 40, 42 are received in cross-slots 45 in channels 44 to engage the conductors 46, in a manner to be described in greater detail, to provide a current path from the contacts 40, 42 to the conductors. Each of the contacts 40, 42 includes barbs 56 adjacent the end wall portion 54 that extend from the contacts 40, 42 to engage the adapter body 20. The engagement between the barbs 56 and the adapter body 20 secures the contacts 40, 42 within the adapter body 20 by limiting relative movement, specifically a sliding movement, between the contacts 40, 42 and the recesses 38 of the adapter body 20. When contacts 40, 42 are seated in the recesses 38, the elongated portions 52 extend from the recesses 38 into notches 57 of body 20 adjacent the opening defined by channels 30, 32. The elongated portions 52 of the electrical contacts 40, 42 have different lengths such that the points of contact between the respective contacts 40, 42 and the rail 14 will be offset. This provides for contact between the contacts 40, 42 and opposite end portions of the rail 14 as will be described in greater detail below.

Figure 5:
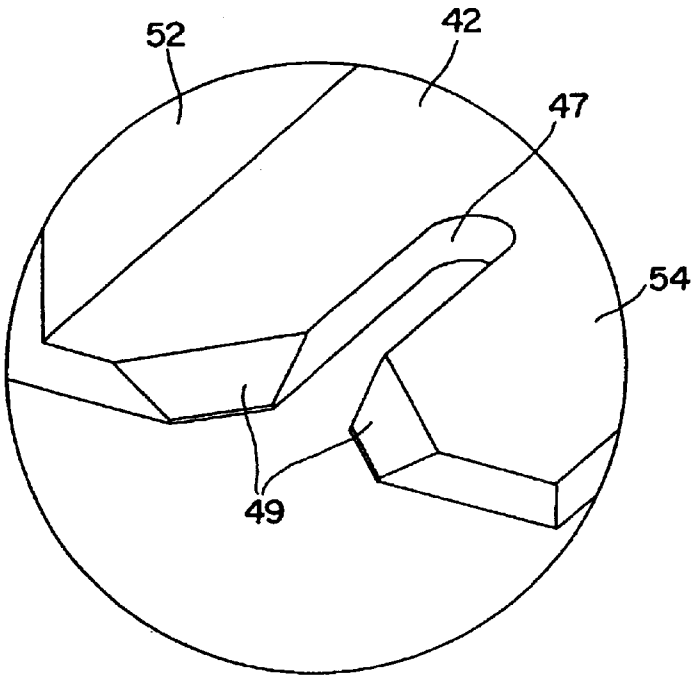
FIG. 5 is an enlarged detail view of a portion of one of the contacts of FIG. 3.

Each of the electrically conductive contacts 40, 42 of the adapter assembly 16 includes a slot 47 in the end wall portion 54 (as shown in the detail view of FIG. 5). The slots 47 are dimensioned to receive and retain lighting fixture conductors 46 for electrical connection between the contacts 40, 42 and the lighting fixture. The end wall portions 54 of the contact 40, 42 include tapered portions 49 adjacent the slots 47. The tapered portions 47 provide a sharp edge that functions to pierce through an outer insulating layer of the conductors 46 when the contacts 40, 42 are engaged to the conductors 46, as will be described below.

Figure 10:
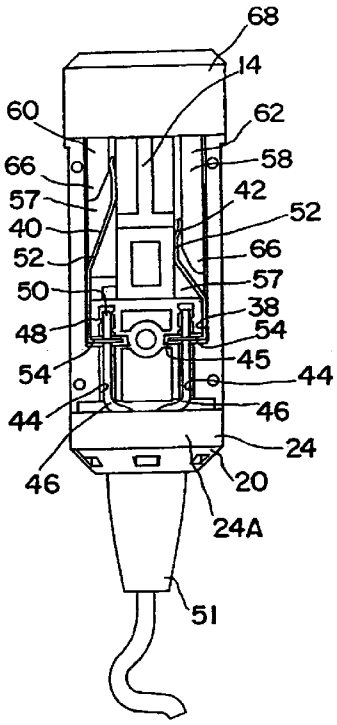
FIG. 10 is a side view, partly in section, of the adapter assembly of FIG. 3 showing the wedge fully inserted into the adapter body and engaged with the electrical contacts.
Figure 9:
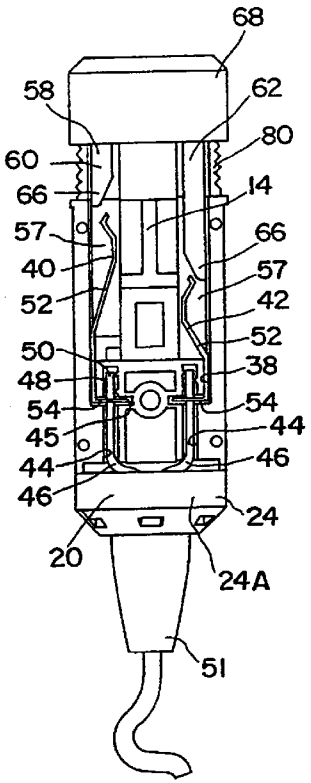
FIG. 9 is a side view, partly in section, of the adapter assembly of FIG. 3 showing the wedge partially inserted into the adapter body but not engaged with the electrical contacts.
Figure 8:
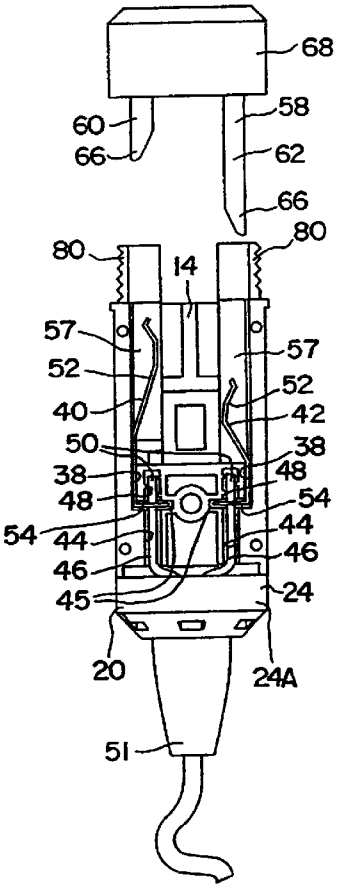
FIG. 8 is a side view, partly in section, of the adapter assembly of FIG. 3 showing the cap and wedge removed from the adapter body.

The pendant lighting fixture 12 of FIG. 1 includes a fixture connector 51 for support of the lighting fixture 12 from the body 20 of adapter assembly 16. The fixture connector 51 includes a threaded portion 53, shown in FIG. 3, for securing the connector 51 to an end portion 24A of the second half 24 of body 20. The conductors 46 extend through the connector 51 and the end portion 24A of body 20 from the lighting fixture 12 (as shown in FIGS. 8–10) for connection to the electrical contacts 40, 42 in channels 44 as will be described in greater detail.

The adapter assembly 16 further includes a wedge 58 providing for engagement and disengagement between the electrical contacts 40, 42 and the rail 14. The wedge 58 includes arms 60, 62 extending from an annular base 64. Arm 62 is longer than arm 60 to provide for engagement between wedge 58 and the elongated portions 52 of contacts 40, 42 that have different lengths. As shown in FIG. 3, the elongated portions 52 of contacts 40, 42 have different widths such that the elongated portion 52 of contact 42 is wider than the elongated portion 52 of contact 40. Arm 62, in a similar fashion, is wider than arm 60. The arms 60, 62 are received in the notches 57 of the first and second halves 22, 24 of the adapter body in which the elongated portions 52 of the contacts 40, 42 extend. The notch 57 in which arm 62 and contact 42 are received is wider than the notch 57 in which arm 60 and contact 40 are received. This construction ensures that wedge 58 is received correctly by the body 20 such that arms 60, 62 engage contacts 40, 42, respectively. Each of the arms 60, 62 includes a tapered portion 66 at a terminal end to facilitate movement of the elongated portions 52 of contacts 40, 42 towards the rail 14 as will be described in greater detail.

Figure 6:
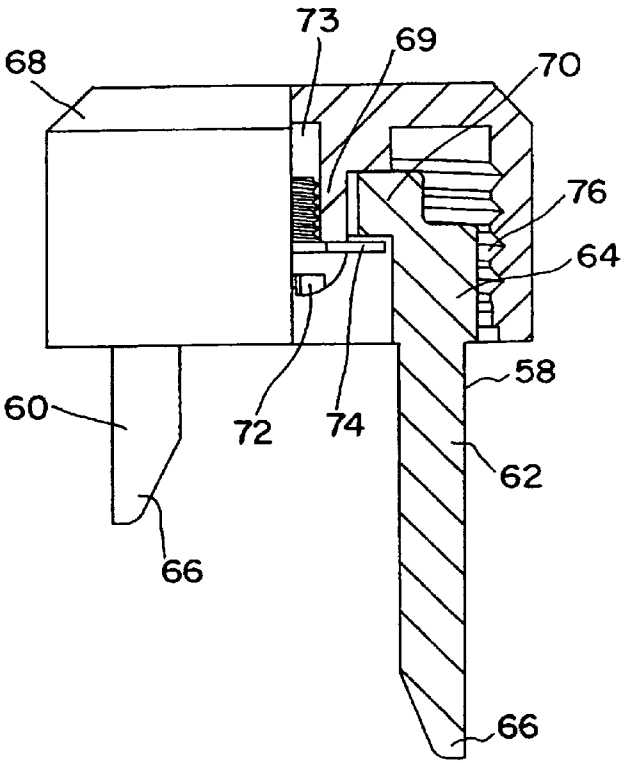
FIG. 6 is a side view, partly in section, of the cap and wedge of FIG. 3.

The adapter assembly 16 further includes a cap 68 seated on a reduced diameter portion 70 of the wedge base 64. Cap 68 has a depending cylindrical projection 69 received in a corresponding opening 71 in wedge 58. An annular disc 74 is secured to the cap 68 to maintain connection between the cap 68 and the wedge 58. A screw 72 engages an internally threaded bore 73 of the projection 69 to secure the cap 68 to the wedge 58. As shown in FIG. 6, the reduced diameter portion 70 of wedge 58 and the cap 68 are dimensioned such that the annular disc 74 is secured to the cap 68 without compressing reduced diameter portion 70 of the wedge 58 between the cap 68 and the annular disc 74. The clearance provided between the annular disc 74, wedge 58 and cap 68 allows the cap 68 to freely rotate on the wedge 58 with the annular disc 74 secured to the cap 68 to maintain the cap 68 on the wedge 58.

Figure 7:
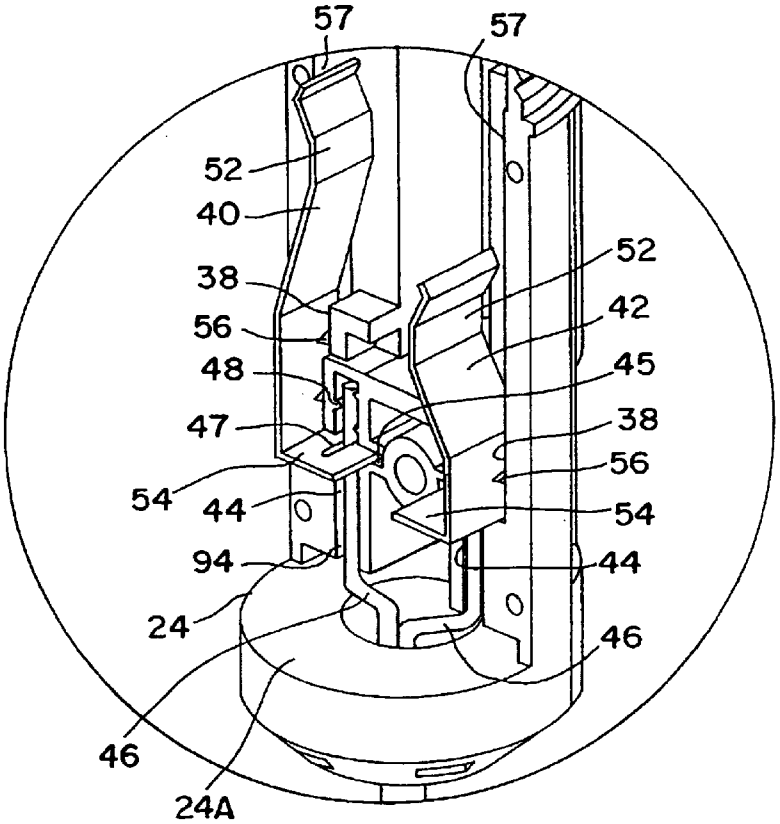
FIG. 7 is an enlarged detail of a portion of the adapter assembly of FIG. 3 showing lighting fixture conductors received by the adapter body and engaging the contacts.

The above-described construction of the adapter assembly 16 provides for simple installation of a lighting fixture to rail 14 of rail lighting system 10, as shown in FIGS. 7–10. The adapter assembly 16 is connected to a lighting fixture, such as pendant fixture 12, in the following manner. The conductors 46 of the lighting fixture are received in the channels 44 of body 20 through the end portion 24A of the second half 24, as shown in FIG. 7. The conductors 46 are held in position within the body 20 by the projections 48 formed in the channels 44. The electrical contacts 40, 42 are then positioned in the second half 24 of body 20 such that the elongated portions 38 are received in recesses 38 and the end walls are received in cross-slots 45. Securing the first half 22 of body 20 to the second half 24, by engaging screw 26 in the threaded bore 28, causes the contacts 40, 42 to be fully seated within the recesses 38 and cross-slots 45. The seating of the contacts 40, 42 in the recesses 38 and cross-slots 45 results in engagement of the conductors 46 with the slots 47 of end wall portions 54 and piercing of the outer insulating layers, if included, by the tapered portions 49.

Referring to FIG. 8, the rail 14 is shown positioned in the opening of the body 20. Preferably, rail 14 is received in the opening of the body 20 after the halves 22, 24 have been secured to each other. The Prior to engagement of the wedge 58 to the body 20, the elongated portions 52 of the contacts 40, 42 are out of contact with the rail 14 as shown in FIG. 8.

With the rail 14 positioned in the opening of body 20, the wedge 58 is received by the body 20 opposite end portion 24A such that the arms 60, 62 are received in the notches 57 as shown in FIG. 9. With the arms 60, 62 received in the notches 57, the cap 68 is threadedly engaged to the threaded portions 78, 80 of body 20. As described above, the clearance between the annular disc 74, the wedge 58 and the cap 68 provides for relative rotation between the cap 68 and the wedge 58. The rotation between the cap 68 the wedge 58 provides for threaded engagement of the cap 68 with the body 20 while the arms 60, 62 of the wedge 58 are positioned in the notches 57 of body 20. As shown in FIG. 10, the threaded engagement of the cap 68 to the body 20 results in a corresponding advancement of the arms 60, 62 within the notches 57. The arms 60, 62 engage the contacts 40, 42 as they advance within the notches 57 causing the elongated portions 52 of the contacts 40, 42 to be flexed into contact with the rail 14. The differing lengths of the elongated portions 52 of the contacts 40, 42 provides for engagement between the respective contacts 40, 42 and opposite end portions of the rail 14.

The construction of the adapter assembly 16 also provides for simple adjustment in the position of a lighting fixture along the rail 14 in the following manner. Rotation of the cap 68 to partially disengage the cap from the body 20 results in partial withdrawal of the arms 60, 62 from the notches 57. Withdrawal of the arms 60, 62 disengages the arms 60, 62 from the elongated portions 52 of the contacts 40, 42 such that the elongated portions 52 return to an unflexed condition, out of contact with the rail 14, as shown in FIG. 9. With the elongated portions 52 out of contact with the rail 14, the adapter assembly 16 is free to be moved along the rail without marring the rail 14.

Figure 11:
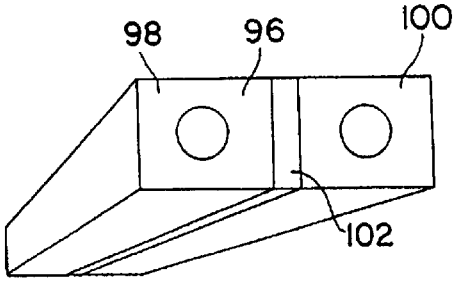
FIG. 11 is perspective view of a single circuit rail as used in the present invention.

Referring to FIG. 11, there is shown a rail 96 according to the present invention for use with the adapter assembly 16 previously described. The rail 96 has a relatively short width and a relatively long depth adapted to fit within the opening defined by the body 20. The rail 96 is a single circuit rail having a hot conductor 98 located at one end portion of the rail 96 with respect to its depth and a common conductor 100 located at an opposite second end portion of the rail. An insulating layer 102 separates the hot conductor 98 and the common conductor 100 from each other.

Figure 12:
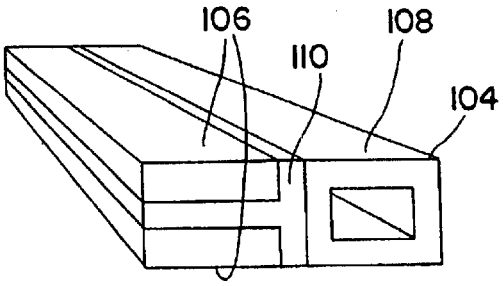
FIG. 12 is a perspective view of a dual circuit rail as used in the present invention.

Referring to FIG. 12, there is shown a rail 104 also adapted for use with the adapter assembly 16 previously described. The rail 104 includes a short width and long depth similar to rail 96 to provide for receipt of the rail by the opening defined by the body 20. Rail 104, however, differs from rail 96 in that rail 104 is a dual circuit rail. Rail 104 includes hot conductors 106 at one end portion of the rail with respect to its depth. Rail 104 further includes a box-section common conductor 108 located at an opposite end portion of the rail from the hot conductors 106. Rail 104 includes a T-shaped insulating member 110 to provide for electrical separation between the hot conductors 106 and the common conductor 108 and electrical separation between the hot conductors 106.

Figure 13:
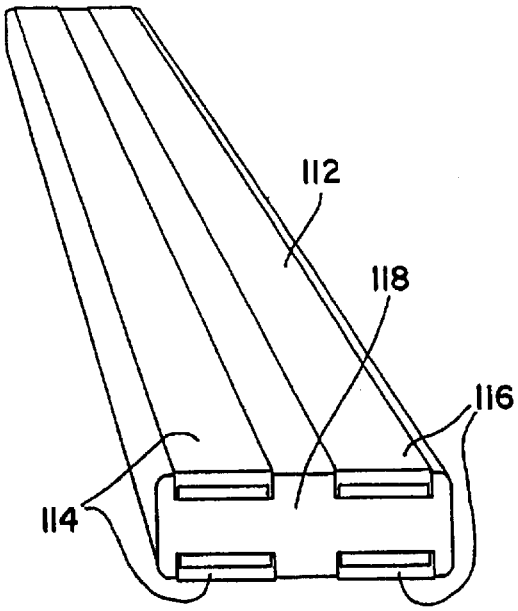
FIG. 13 is a perspective view of a dual circuit rail as used in the present invention.

In FIG. 13, there is shown a rail 112 usable with the adapter assembly 16. The rail 112 includes a short width and long depth, similar to rails 96, 104, to provide for receipt of the rail by the opening defined by the body 20. The rail 112 is a dual circuit rail and includes hot conductors 114 and common conductors 116 located in opposite end portions of rail 112 with respect to its depth. The hot conductors 114 and common conductors 116 are located on opposite sides of rail 112 from each other with respect to the width of the rail 112. An insulating member 118 separates the hot conductors 114 in the one end portion of rail 112 from the common conductors 116 in the opposite end portion. The insulating member 118 further separates one set of the hot and common conductors 114, 116 on one side of the rail 112 from the other set of conductors 114, 116.

The uniform size of rails 96, 104, 112 shown in FIGS. 11–13 provides for use of any of the rails with the adapter assembly 16. As described previously, the conductors 40, 42 have elongated portions 52 that differ in length with respect to each other such that the point of contact between contact 40 and the rail is offset from that of contact 42 with respect to a depth of the rail. This construction provides for universal application of the adapter assembly 16 with the any of the single or double rails 96, 104, 112, for example. This would not be possible with a construction having symmetrical contacts on opposite sides of the rail (i.e., a construction adapted for a single circuit rail).

Referring to FIGS. 14–18, there is shown a spring clip 120 according to the present invention. The spring clip 120 is a dual-purpose clip providing for securing a lamp having a notched base to a socket or, alternatively, to secure a containment barrier to the socket for a pressurized lamp.

Figure 15:
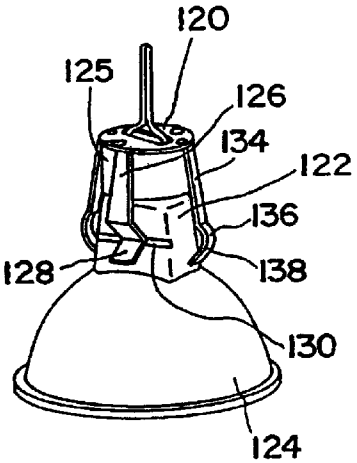
FIG. 15 is a perspective view of the spring clip and lamp of FIG. 14.
Figure 14:
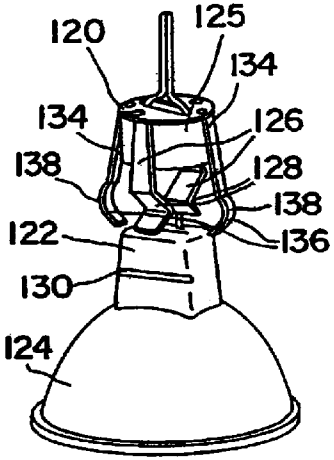
FIG. 14 a perspective view of a spring clip according to the present invention, disengaged from a reflector-type lamp.

Referring first to FIGS. 14–15, the dual-purpose spring clip 120 is shown being used to secure the base 122 of a lamp 124 to a socket 125. The spring clip 120 includes oppositely located tangs 126 having V-shaped end portions 128. The V-shaped end portion 128 of each of the tangs 126 defines an edge adapted to engage a notch 130 on opposite sides of the lamp base 122.

Figure 17:
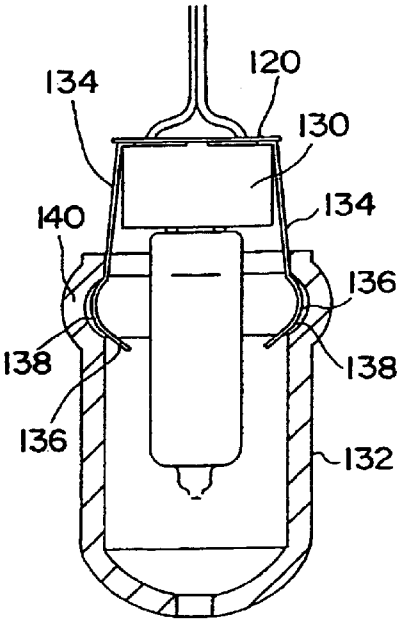
FIG. 17 is a side view, partly in section, of the spring clip and envelope barrier of FIG. 16 showing the spring clip engaged with the envelope.
Figure 16:
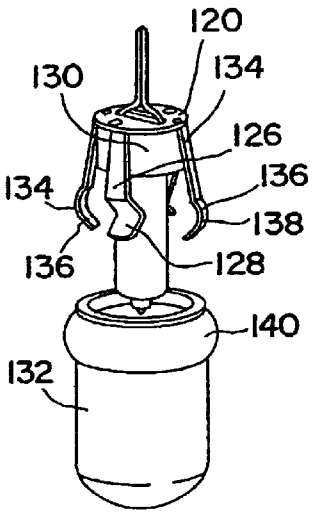
FIG. 16 is a perspective view of the spring clip of FIG. 14 showing the clip disengaged from an envelope barrier for a pressurized lamp.

Referring to FIGS. 16–17, the dual-purpose spring clip 120 is shown being used in its alternative function to secure a containment barrier 132 to the socket 130 of a pressurized lamp. The dual-purpose spring clip 120 includes oppositely located tangs 134 that are perpendicularly oriented with respect to tangs 126. An end portion 136 of each of the tangs 134 is curved to present a convex surface 138 on an outer surface of the tang 134 with respect to the spring clip 120. The convex surface 138 is adapted for engagement with a correspondingly curved portion 140 of the containment barrier 132 as shown in FIG. 24.

Figure 18:
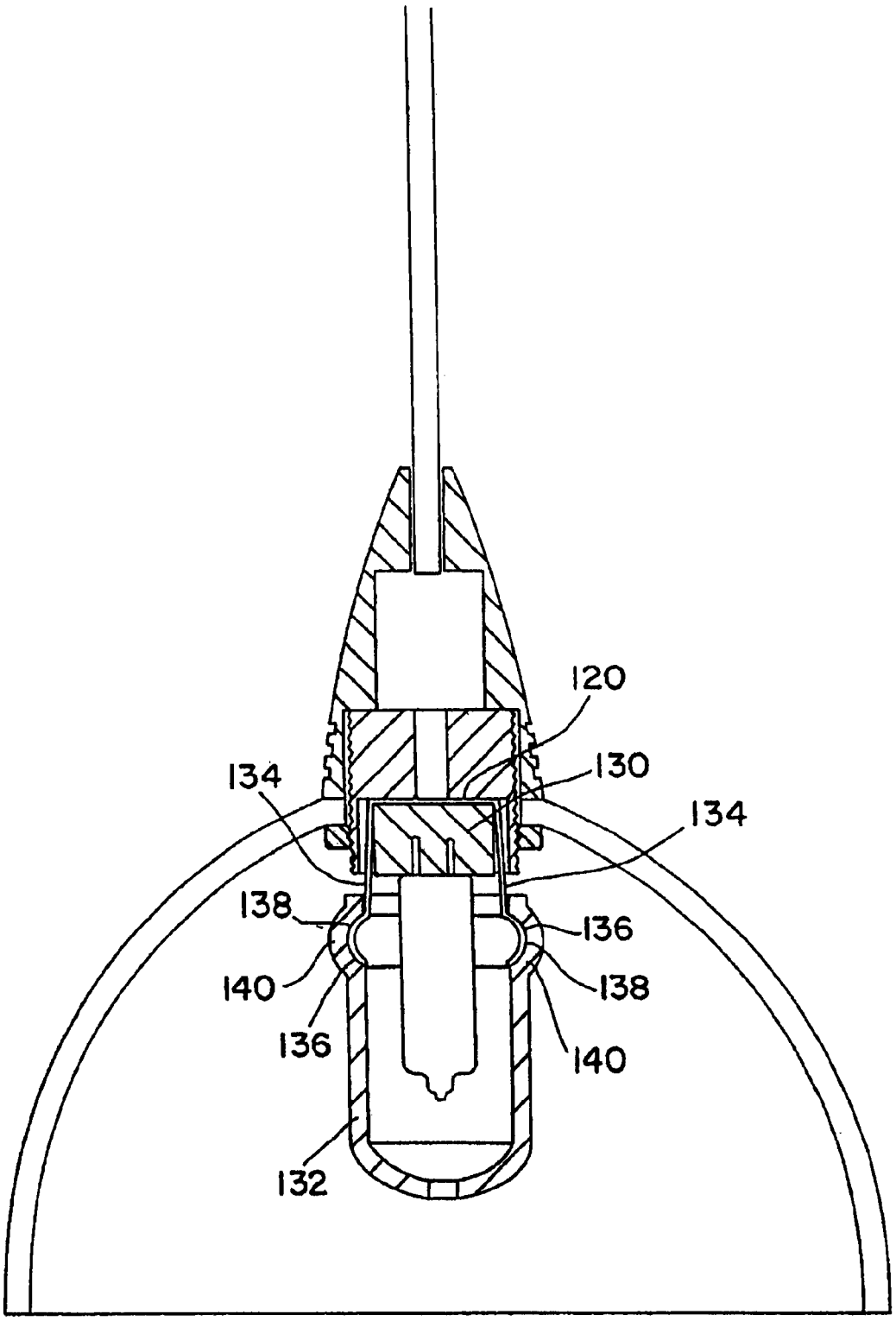
FIG. 18 is a side view, partly in section, showing the spring clip and envelope barrier of FIGS. 14–17 used in a pendant light fixture.

Referring to FIG. 18, the dual-purpose spring 120 is shown being used in conjunction with a pendant lamp 142.

While the present invention has been described in connection with the preferred embodiments of the various figures, it is to be understood that other similar embodiments may be used or modifications and additions may be made to the described embodiments for performing the same function of the present invention without deviating therefrom. Therefore, the present invention should not be limited to any single embodiment, but rather should be construed in breadth and scope in accordance with the recitation of the appended claims.

What is claimed is:

1. An adapter for securing a lighting fixture to the rail of a rail lighting system, comprising:

a body having an opening for receiving the rail of a rail lighting system, first and second electrically conductive contact members supported by the body, each contact member having an elongated portion adjacent the opening and having a length sufficient to contact a respective electrical conductor of the rail of a rail lighting system received in the opening; and a wedge insertable into the body, the wedge having first and second portions each having a shape and dimensions sufficient to contact the elongated portion of the respective electrically conductive contact member when the wedge is fully inserted into the body, the contact between the wedge and the contact members resulting in movement of the elongated portions of the contact members toward the respective electrical conductors of the rail of the rail lighting system.

2. The adapter according to claim 1, wherein the wedge includes a base and wherein the first and second portions comprise respective first and second members extending from the base.

3. The adapter according to claim 1, wherein the body includes notches located on opposite sides of the body communicating with the opening, the body further including recesses in which the contact members are received, the recesses being arranged to receive the contacts such that the elongated portions of the contacts extend from the recesses into the notches.

4. The adapter according to claim 3, wherein the body further includes channels adapted for receipt of first and second lighting fixture conductors, and wherein each contact member includes a slot for receipt of a conductor of the lighting fixture.

5. The adapter according to claim 1, wherein the body includes first and second mating halves.

6. The adapter according to claim 4, wherein each of the electrically conductive contact members includes at least one tapered portion adjacent the slot.

7. The adapter according to claim 4, wherein each of the channels includes at least one projection for engagement with one of the lighting fixture conductors.

8. The adapter according to claim 1, wherein each of the electrically conductive contact members includes at least one barb engaging the adapter body to limit sliding movement between the contact member and the adapter body.

9. The adapter according to claim 1, wherein the elongated portion of one of the electrically conductive contact members is longer than the elongated portion of the other of the electrically conductive contact members.

10. The adapter according to claim 2, wherein each of the members of the wedge includes a tapered end portion opposite the base to facilitate the contact between the wedge and the elongated portions of the contact members.

11. The adapter according to claim 2, wherein the first and second electrically conductive contact members include long and short elongated portions, respectively, and wherein the first and second members of the wedge have elongated lengths that are short and long, respectively.

12. The adapter according to claim 1 further including a cap secured to the wedge, the cap including a threaded portion for removable engagement with an end of the body.

13. The adapter according to claim 12, further including an annular disc secured to the cap, the wedge including a reduced diameter portion positioned between the annular disc and the cap.

14. A rail lighting system comprising:

a rail including first and second electrical conductors;

at least one adapter comprising a body, the body having an opening in which the rail is received, the adapter further including first and second electrically conductive contact members supported by the body, each contact member having an elongated portion adjacent the opening and having a length sufficient to contact one of the electrical conductors of the rail, the adapter further including a wedge insertable into the body, the wedge having first and second portions each having a shape and dimensions sufficient to contact the elongated portion of the respective electrically conductive contact member when the wedge is fully inserted into the body, the contact between the wedge and the contact members resulting in movement of the elongated portions of the contact members toward the respective electrical conductors of the rail; and a lighting fixture secured to the body of each of the adapters, the lighting fixture including a pair of electrical conductors extending from the lighting fixture and received by the body of the adapter, each of the electrical conductors of the lighting fixture electrically connected to one of the contact members of the adapter.

15. The rail lighting system according to claim 14, wherein the rail has a depth and opposite end portions with respect to the depth, the rail including at least one conductor located in each of the end portions, and wherein the elongated portions of the first and second contact members have lengths that are long and short, respectively, such that the elongated portions of the contact members extend to conductors in opposite end portions of the rail.

16. The rail lighting system according to claim 15, wherein at least one of the end portions of the rail includes conductors on opposite sides of the rail with respect to a width of the rail.

17. The rail lighting system according to claim 15, wherein each of the end portions of the rail includes conductors on opposite sides of the rail with respect to a width of the rail.

* * * * *